US006225940B1

(12) United States Patent
Ohlsen

(10) Patent No.: US 6,225,940 B1
(45) Date of Patent: May 1, 2001

(54) RADAR REFLECTING SYSTEM AND METHOD FOR SMALL WATER CRAFT

(76) Inventor: Kenneth A. Ohlsen, 9532 - 66th Ave. NW., Marysville, WA (US) 98271

( * ) Notice: Subject to any disclaimer, the term of this patent is extended or adjusted under 35 U.S.C. 154(b) by 0 days.

(21) Appl. No.: 09/406,167

(22) Filed: Sep. 23, 1999

Related U.S. Application Data

(60) Provisional application No. 60/101,674, filed on Sep. 24, 1998.

(51) Int. Cl.[7] ..... H01Q 15/14

(52) U.S. Cl. ..... 342/5; 342/7; 342/8; 342/10; 342/41; 343/709; 343/710; 441/35

(58) Field of Search ..... 342/5, 6, 7, 8, 342/9, 10, 11, 23, 24, 41; 343/709, 710; 441/35, 36, 38, 136

(56) References Cited

U.S. PATENT DOCUMENTS 3,019,457 * 2/1962 Lowery ..... 441/36
3,130,406 * 4/1964 Jones-Hinton et al. ..... 342/8
3,155,992 * 11/1964 Shewmake et al. ..... 441/38
5,179,382 * 1/1993 Decker ..... 342/8

* cited by examiner

*Primary Examiner*—Bernarr E. Gregory
(74) *Attorney, Agent, or Firm*—Robert B. Hughes; Hughes & Schacht, PLLC

(57) ABSTRACT

A detection system for small water craft, such as a kayak. Radar reflective material is incorporated in the surface of the kayak or other water craft, and also is incorporated in surface areas of water craft accessories, such as cushion, life vest or paddle. When the smaller water craft is in the vicinity of a larger aircraft which may be radar equipped so that there is danger of a collision or where the water craft is in a position where it would want detection as part of a rescue effort or the like, the water craft is oriented so that the radar reflective surface would reflect radar back to the sending source, thus better enabling detection. Also, the paddle or other water craft accessory could be positioned so as to reflect the radar waves. Further, the paddle or other accessory could be oriented to reflect the radar waves back to the source, or do so intermittently, in the event that the radar system is programmed to ignore a constant reflective signal.

5 Claims, 2 Drawing Sheets

RADAR REFLECTING SYSTEM AND METHOD FOR SMALL WATER CRAFT

This application claims benefit to U.S. provisional application No. 60/101,674 filed Sep. 24, 1998.

BACKGROUND OF THE INVENTION

1. Field of the Invention

The present invention relates to a radar reflecting system and method for water craft, and more particularly to such a system and method which would be particularly adapted for small water craft, such as kayaks, which have water craft accessories, such as paddles.

2. Background Art

It is quite common for larger water craft to be equipped with a radar warning system to avoid collisions. However, small size water craft, such as kayaks, canoes, etc. are notoriously difficult to be detected by such radar systems, and many marine accidents with small water craft result from this lack of radar visibility. Also, if waves are present so that the water craft is dropping to lower and higher levels relative to the water surface, the problem of detection by radar is substantially increased.

A search of the patent literature has disclosed a number of concepts relating in general to the detection of people and/or objects in a nautical environment. Among these are the following:

U.S. Pat. No. 5,454,742 (Robertson) deals with the problem of locating buoys. Fisherman commonly use floating buoys to indicate the location of fish traps and lobster pots to provide rapid identification and recovery of traps or pots. Metal type buoys are often detected under poor visibility conditions employing the vessel's navigational radar. This patent show an inflatable buoy which is provided with a radar reflecting element. There is a thickened portion of the buoy to which is mounted a corner radar reflector that can be positioned so that the location is more visible to the radar.

U.S. Pat. No. 5,421,287 (Yonover) shows a locating device for a person who is lost at sea. There is an elongate brilliant colored streamer made up of a flat, flexible buoyant material which is unrolled to its flat configuration and floats on the surface of the body of water. This sheet includes a surface of radiation reflecting material.

U.S. Pat. No. 4,987,848 (Todd) shows what is called "radar reflecting safety flag". There is a flag, such as a national flag, made of a highly radar reflective material. This is a dual purpose safety flag carrying non emergency identification (such as the idicia on the flag) and also a flexible radar reflecting portion of silver anodized rip-stop nylon.

U.S. Pat. No. 4,970,516 (Nicolson) relates to a system for "diverting attention" from a sea going vessel which is vulnerable to enemy attack by projectiles, whether traveling on the sea, under the sea, or in the air, and whether the detection be by radar, sonar or infra-red detectors. There is provided a "sacrificial sea-going vessel" that is made with a greater signature so that the sacrificial decoy vessel constitutes a "preferred target" over the ocean vessel. The propulsion and directional steering of the decoy vessel is controlled so as to maintain the vessel within a predetermined distance of the sea-going vessel as the sea-going vessel moves along its travel path. The sacrificial decoy generates signals which attract hostile projectiles and which are substantially greater in magnitude than the projectile attracting signals from the sea-going vessel.

U.S. Pat. No. 4,809,638 (Kolesar) describes a system for locating a person who is floating in the ocean or other body of water. A material is spread around the person on the surface of the water to provide reduced surface tension on the surrounding water to eliminate "capillary waves" on the water surface. Thus, the adjacent water surface has a slick appearance relative to the surrounding water so as to have a reduced radar back scatter with respect to the surrounding water. This enables better visual, radar and IR detection.

SUMMARY OF THE INVENTION

The present invention is particularly adapted to enable a small water craft and/or a person in the water craft to reduce the possibility of a collision by causing a reflection of a radar signal to enhance detection of the water craft and/or person in the water craft.

This is accomplished by providing a radar reflective layer in a surface area of a surface of the water craft or a water craft accessory. The surface area having the reflective material has an alignment axis or an array of alignment axes perpendicular to the surface area and/or portions of the surface area. For example, the surface area could be substantially flat, in which case there would be only a single alignment axis perpendicular to the plane of the flat surface. Alternatively, the surface area could be curved or have multiple angled surface segments so that there would be a plurality or an array of alignment axes extending in generally the same direction but angled somewhat from one another. This would reduce the necessity of having a very accurate alignment of the surface area relative to the direction of the radar waves.

The person in the water craft may observe or otherwise detect the presence of a second water craft, possibly at a nearby location where there is a possibility of a collision. If the water craft is a large water craft, there is a higher likelihood of this water craft having a radar detection apparatus. Thus, when the person in the smaller water craft sees or otherwise detects the larger water craft, the person in the smaller water craft would orient his smaller water craft so that the radar reflective surface area of the surface of the water craft would be oriented so that the axis or array of axes of the surface area is or are aligned with an alignment axis from the radar unit to the water craft and/or person. Also, in addition to orienting the water craft (or as an alternative) the person could place a water craft accessory in a position so that the radar reflective surface of the accessory would be oriented to reflect the radar back to the source of the radar wave. The accessory could be, for example, a paddle, a cushion, or a life vest. Thus, the radar waves traveling from the radar apparatus to the surface area of the water craft or the accessory are reflected back to the radar apparatus to cause detection of the water craft and/or the person in or adjacent to the water craft.

With regard to the placement of the surface area, this could also be placed in a horizontal or near horizontal portion of the water craft, such as in the floor of a life boat, or in the top deck portion of the water craft. Thus, if the radar apparatus is an aircraft that is in a search and rescue mission, the water craft would provide a better reflected target for a radar apparatus in the aircraft.

Also, the present invention is directed toward the water craft itself, incorporating the radar reflective surface or surfaces, and also to the accessories associated with the water craft incorporating the radar reflective surface or surfaces. Other features will become apparent from the following detailed description.

DESCRIPTION OF THE PREFERRED EMBODIMENT

Figure 1:
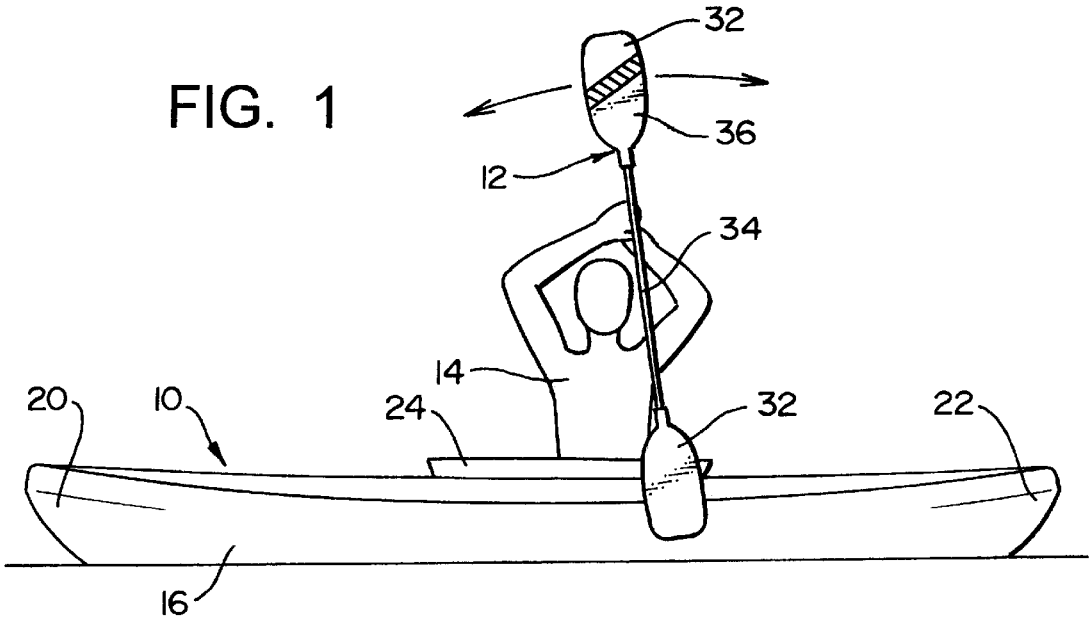
FIG. 1 is a side elevational view, illustrating the overall system and method of the present invention, where a person is seated in a kayak and manipulating the paddle to enhance radar detection.

With reference to FIG. 1, the system of the present invention is shown in a use situation, where a kayak 10 is floating on a body of water, and there is kayak accessory (in this instance a paddle 12) which is held by a person 14 seated in the kayak 10. As will be disclosed in more detail hereinafter, the surfaces of both the kayak 10 and the paddle 12 are provided with radar reflecting material that is laminated in the hull structure of the kayak 10 and in the paddle 12. While the present invention is described as incorporated in a kayak and kayak paddle, it would be used in other small water craft, such as canoes, Jet skis, sail boats, etc.

Figure 2:
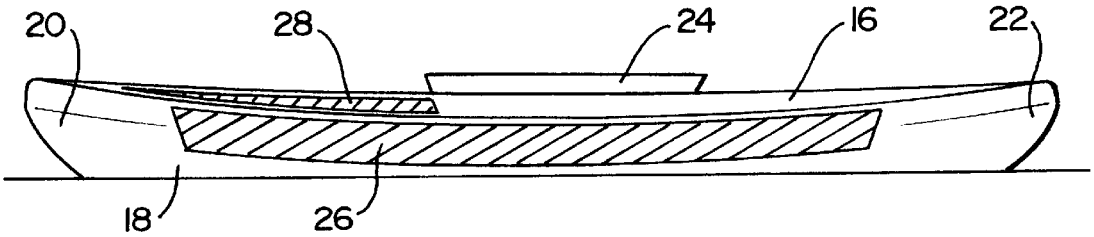
FIG. 2 is a side elevational view of a kayak incorporating the reflective surface material to facilitate radar detection.

FIG. 2 shows the hull 16 of the kayak, with the portions of the exterior surface 18 of the hull 16 where the radar reflecting material is present. The kayak itself can be conventional, and as shown herein, it has a bow 20, a stern 22 and a central cockpit area 24. The surface areas in which the radar reflective material is incorporated are shown as being shaded in FIG. 2. Each of the side surfaces of the kayak material is shown with a substantial shaded area 26 where the radar reflective material is located. Also the upper forward surface portion 28 has the radar reflective material incorporated therein. Obviously, this radar reflective material could be extended and incorporated in other surface areas of the kayak 10.

While the present invention is being shown incorporated in a kayak, obviously, it can incorporated in some other type of water craft, such as a canoe, a rowboat, a life raft, a dingy, a sailboat, etc. Further, the radar reflective area could be located in the floor of the life raft which would make it more easily detected by an airplane or other aircraft that would be located above the water craft in its search and rescue mission.

The paddle 12 has (or may have) substantially the same overall configuration of a conventional kayak paddle, and thus comprises two end paddle portions 32, joined by a central elongate connecting rod or handle portion 34. Substantially the entire surface 36 of each paddle portion 32 has the radar reflective material incorporated therein, and this radar reflective material could be on only one side or both sides of each paddle portion 32.

The basic structure of both the kayak 10 and the paddle 12 may be conventional, and in the present invention, the manufacturing of both the kayak 10 and the paddle 12 can be accomplished in an overall conventional manner. Kayaks and kayak paddles are typically manufactured using fiberglass and other laminates, and using a "wet lay-up" technique. Several layers of fiberglass, Kevlar (a trademark), graphite, or other fabrics are "laid up" with resin dispersed in-between and into the fabric. As is commonly done in the prior art, the directional length of each fabric layer is normally placed at different angles to give the kayak 10 and also the paddle 12 greater overall strength. As part of this process, the radar reflective layer is also positioned as a laminate in the mold, and thus ends up as a layer embedded in the end structure.

When this is completed, the material (positioned in the mold of the overall configuration of the kayak) is covered with a release paper and fitted with a vacuum bag. The edges of the vacuum bag are sealed to edges of the mold. The vacuum is then used to pull air out of the resin and cause the layers to conform to the mold contours. An air relief valve is typically fitted into the vacuum bag to facilitate this. When the air is out of the system, the kayak is allowed to cure. At a later time it is removed from the mold. The paddle 12 can be manufactured in substantially the same way.

The radar reflecting material would normally be metallic in nature, and could be made as a metal cloth. One such metal cloth would be that sold by the Swift Metal Textile Company located at P.O. Box 150, Hartford, Conn. 06141. Also, various metal foils, such as common aluminum foil can also be used.

Radar reflectivity could be increased by various techniques, many of which are known in the prior art. For example, radar reflectivity could be enhanced by mixing a metallic microcrystaline material into the bonding resin during the manufacturing process. This process would be especially applicable for particular types of small personal water craft in which the present invention could be used, such as kayaks, sail boats, Jet skis (trademark), etc.

Figure 3:
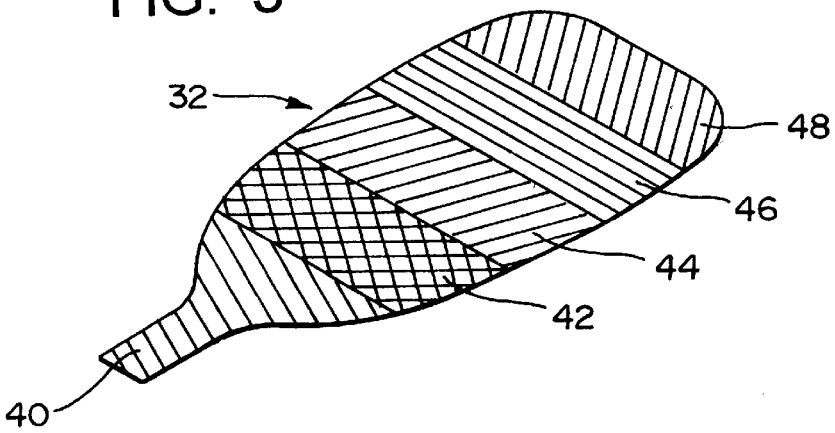
FIG. 3 is an isometric view showing a portion of a paddle incorporating the reflective surface of the present invention, and having surface portions cut away to show the various laminates that make up the paddle.

FIG. 3 shows the lay up of the laminates in accordance with one preferred arrangement. This is shown with reference to one of the paddle portions 32 of the paddle 12, but this same basic lay up could also be used in the kayak hull. In FIG. 3, the basic structural component 40 of the paddle 12 is shown with portions of the laminates removed therefrom for purposes of illustration. As shown herein, the radar reflective layer 42 is shown being applied directly to the underlying structure 40. The next layer is shown as a Kevlar laminate 44. Next there are two fiberglass layers 46 and 48, having the fiber orientation slanted to provide greater structural strength. Alternatively, the radar reflective layer 42 could be positioned closer to the surface of the kayak 10 and/or paddle 12. It is to be understood that the arrangement of the laminations in the hull 16 of the kayak 10 could be the same as, or similar to, what is shown in FIG. 3.

Figure 4:
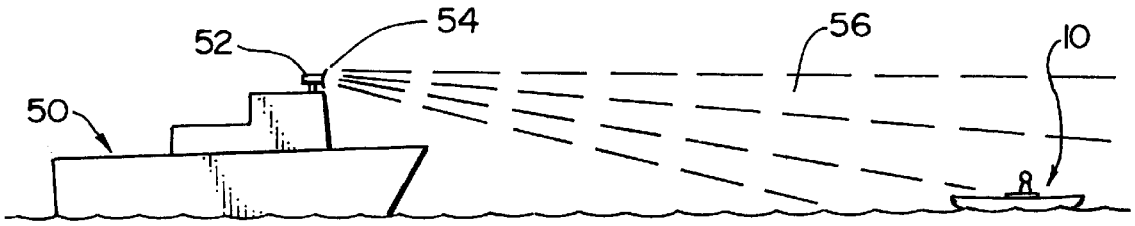
FIG. 4 shows schematically the use of the present invention in a kayak in a situation where there is a radar equipped larger vessel nearby.

To describe the operation of the present invention, reference is made to FIG. 4 which shows a larger ship 50 which is equipped with a radar detecting apparatus 52. This radar apparatus 52 comprises a transmitting/receiving antenna 54 which transmits its radar pulses directionally in an expanding directional pattern indicated at 56. With the radar transmitter/receiver 54 continuously rotating a full 360 degrees, it makes a sweep of the surrounding water surface.

In general, the radar pulses would be transmitted at a particular frequency, and the reflected pulses would be received at the same antenna 54 and processed in a certain manner to indicate the location of the object from which the radar pulses were reflected. In FIG. 4, there is shown the kayak 10 located on the water surface at the location where the radar beam 56 is being directed.

Let us assume that the person 14 in the kayak 10 perceives that his kayak 10 is either in or near the path of travel of the vessel 50, and while the person 14 wishes to maneuver his kayak 10 so that it would be out of the path of the vessel 50, in addition, he wants to do his best to make sure that the radar system of the vessel 50 detects the presence of his kayak 10.

One maneuver would be for the person to orient the kayak 10 so that the side reflective surface 26 of the kayak is facing the radar transmitter 54 so that the reflection of the radar pulses would be optimized. In addition, the person could position and orient the paddle 32 so that the paddle surface 36 is facing the radar transmitter/receiver 54 and is clearly visible to the radar.

To enhance the probability of being detected in the radar system, the person could possibly take other steps. This could depend to some extent on the design and operational characteristics of the radar surveillance system. For example, some radar surveillance or control systems (e.g. in airports) are computerized so that if an object is detected as remaining stationary, this will not appear on the screen (the reason for this being to keep the screen from being cluttered). Thus, if the radar system in the larger ship 50 would be of this type, the paddle could first be positioned so as to reflect the radar pulses for a short period of time, then either move to a lower location or rotated to an angle to minimize reflection, and then back to the orientation so that reflection is maximized, with this alternating movement be repeated.

Also, the radar responsive components of the paddle 12 and the kayak 10 could be specifically designed so as to optimize their radar detection capabilities. One approach would be to improve the "directionality" of the reflective surface. A surface which is perfectly flat would have more of a tendency to reflect back to the transmitting source only in situations where the reflective surface is at right angles to the line of transmission within a very close tolerance. However, when the person in a kayak is attempting to orient the kayak at the proper angle relative to the radar transmitter/receiver, or to orient the surface of the paddle portion 32 to the transmitter/receiver transmitting line, it may be difficult to obtain precise alignment. Accordingly, the radar reflecting laminate 42 may itself be structured in a manner to broaden its angle of reflection so that it would be capable of having a relatively high capacity for reflecting the radar pulse and yet have some tolerance in the alignment relative to the direction of the radar pulse. This could be accomplished, in various ways. For example, it would be possible to provide the reflective surface 42 with rather shallow circularly curved dimples so that the reflecting path would be within an angle of several degrees. There would be other ways of accomplishing this, but since these are already known in the prior art, these will not be recited at length in this text.

Another possibility to enhance the capability of the present invention to make the kayak 10 or paddle 12 more detectable would be to impart the characteristics of an antenna to the reflective layer 42. As indicated above, the radar pulses would normally be transmitted at a certain frequency. If the reflective layer 42 would be arranged so that it would function as a receiving/transmitting antenna, tuned to the frequency of the radar system 52, then the transmission back to the transmitting/receiving antenna 54 could be strengthened, thus making the kayak more detectable.

There are various configurations of receiving/transmitting antennas that appear in the prior art. For example, an electromagnetically responsive component which is arranged in a spiral (e.g. a circular spiral or a square spiral) could be arranged so as to have a resonant frequency the same as the transmitting frequency of the radar. This design could be optimized relative to the radial spacing of the tuned elements, their widths, and also the total length. If this approach is used, then the lamination 42 could be provided as a base sheet having the metallic antenna imprinted thereon. Then the sheet would simply be placed in the lay up, as shown in FIG. 3 and made in integral part of the paddle or kayak structure.

Figure 5:
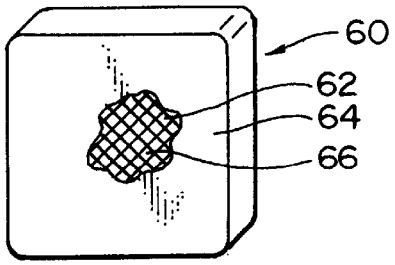
FIG. 5 shows the present invention embodied in a cushion which is an accessory of the kayak or other water craft.

A further embodiment of the present invention is shown in FIG. 5, where there is shown a cushion 60 which has (or may have) a conventional configuration. There is a layer of reflective material 62 positioned in the outer cover 64 of the cushion 60. For purposes of illustration, a portion of the outer cover 64 is broken away, as indicated at 66, showing the radar reflective material 62.

The radar reflective material could be incorporated in the construction of the layer 64 in somewhat the same manner as illustrated in FIG. 3 relative to incorporating the radar reflective material 42 in the paddle portion 32. For example, there could be a lower layer of material or fabric, an intermediate layer which would be the radar reflective layer 62, and also an outer layer which likely would be wear resistant and also water resistant. Desirably, the cushion 60 would be constructed so that the reflected surface would have a sufficiently large reflecting area. It could be made planar or near planar. Alternatively, it could be made with a moderate amount of curvature, this giving a certain amount of dispersion to the reflection. Obviously, the configuration of the cushion could be made in various shapes or forms. This cushion could also be constructed as a water-tight flotation cushion, and instead of having primarily a cushion configuration could be configured also in the form of a life jacket that would be worn.

Figure 6:
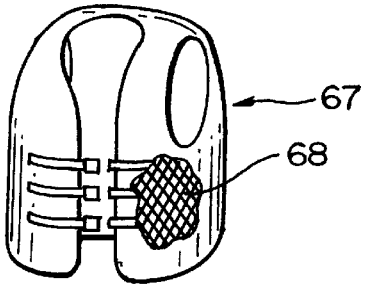
FIG. 6 shows a life jacket incorporating the present invention.

FIG. 6 shows yet another embodiment where the reflected material is incorporated at the surface of a life vest 67. For example, the radar reflective material could be incorporated in the entire surface area of the life vest. This could be done in the same manner as the radar reflected material as incorporated in the cushion, shown in FIG. 5.

Figure 7:
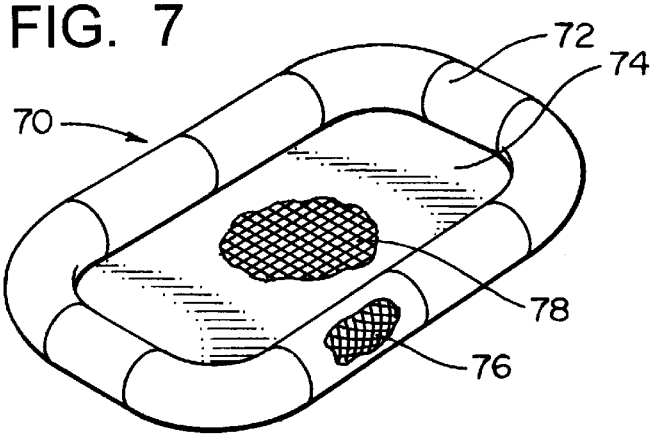
FIG. 7 shows a life raft incorporating the present invention.

Yet another embodiment of the present invention is shown in FIG. 7, which shows a life raft 70, having a surrounding flotation section 72 and a floor 74. It can be that the radar reflective surface is incorporated in the upper and side surface portions of the perimeter flotation portion, part of this surface area being indicated at 76. Also, this radar reflective surface can be incorporated in the bottom floor 74 and a portion of the outer layer of the floor 74 is cut away to show a portion of the radar reflective surface area at 78. This would enhance detection by a radar apparatus which is positioned in an aircraft on a search and rescue mission.

Various modifications on additional features could be made or added, and these should be considered to be within the scope of the present invention.

Therefore, I claim:

1. A method of enabling a small water craft or a person in said water craft to reduce possibility of a collision, by causing a reflection of a radar signal to enhance detection of the water craft or person in the water craft, said method comprising:

a) providing a radar reflective layer in a surface area of a surface of a water craft accessory selected from a group consisting of a paddle, a life vest and a cushion said surface area having an alignment axis or an array of alignment axes perpendicular to said surface area and/or portions of said surface area;

b) observing or detecting presence of a second water craft at a location where radar detection apparatus is in use or another location where radar detection apparatus is in use;

c) enabling said radar detection apparatus to detect location of the water craft or person by orienting the water craft accessory so that the surface area of the surface of the water craft accessory is oriented so that the axis or array of axes of that surface area is aligned with an alignment axis from the radar detection apparatus to the water craft or person, whereby radar waves traveling from the radar detection apparatus to said surface area are reflected back to the radar detection apparatus to cause detection of the water craft or person.

2. The method as recited in claim 1, wherein the water craft accessory is alternately oriented for detection and positioned out of orientation for detection, so that the axis or array of axes of that surface area is in detection alignment and then out of detection alignment alternately, so that reflection of the radar signal directed toward the water craft or person is a series of intermittent reflections, whereby detection of said water craft or person is enhanced by enabling observation of intermittent reflections.

3. A water craft accessory, selected from a group consisting of a paddle, life vest and a cushion, which enables a water craft or person in the water craft to be better enabled to be detected by a radar detecting apparatus, said accessory comprising a structure having a surface; a radar reflective surface area of said accessory surface having incorporated therein a layer of a radar reflective material, said radar reflective material extending along said surface so as to have an alignment axis or an array of alignment axes perpendicular to said radar reflective surface area, said radar reflective surface area being positioned on the surface of the water craft accessory so that the water craft accessory is able to be oriented so that the alignment axis or array of axes is directed in a direction along which a radar detection signal may be sent.

4. The water craft accessory as recited in claim 3, wherein said radar reflective material is configured to function as a transmitting/receiving antenna tuned to a frequency in order that a radar pulse tuned to said frequency could be reflected more effectively.

5. The water craft accessory as recited in claim 4 wherein said frequency is the same as a frequency used in a radar system in a boat for a particular area, where the water craft accessory is situated.

* * * * *